US005813089A

United States Patent [19]

Nolan et al.

[11] Patent Number: 5,813,089

[45] Date of Patent: Sep. 29, 1998

[54] DUCT CLEANING APPARATUS

[75] Inventors: James R. Nolan, Aurora, Ill.; Gary E. Kruse, Lawrenceville, Ga.

[73] Assignee: Abatement Technologies, Inc., Lawrenceville, Ga.

[21] Appl. No.: 732,771

[22] Filed: Oct. 15, 1996

[51] Int. Cl.[6] ..... A47L 5/12; A47L 9/02

[52] U.S. Cl. ..... 15/383; 15/104.095; 15/104.12; 15/395; 15/405; 239/443; 134/167 C

[58] Field of Search ..... 15/104.09, 104.095, 15/104.12, 304, 383, 395, 405; 134/166 C, 167 C, 168 C, 169 C; 239/443

[56] References Cited

U.S. PATENT DOCUMENTS

| | | | |
|---|---|---|---|
| 2,358,557 | 9/1944 | Boyd | 15/104.12 |
| 2,930,531 | 3/1960 | Kennedy, Jr. | 239/443 |
| 3,095,151 | 6/1963 | MacChesney | 239/443 |
| 3,117,726 | 1/1964 | Schoberg | 15/405 |
| 3,912,173 | 10/1975 | Robichaux | 239/443 |
| 4,792,363 | 12/1988 | Franklin, Jr. | 15/314 |
| 5,383,975 | 1/1995 | Faxon | 15/304 |

FOREIGN PATENT DOCUMENTS

| | | | |
|---|---|---|---|
| 3447827 | 7/1986 | Germany | 15/104.12 |

OTHER PUBLICATIONS

Goodway Fall 1995 Catalogue, Catalogue No. 995A, Goodway Technologies Corporation, Stamford, Connecticut (Sep. 1, 1995).

*Primary Examiner*—Randall E. Chin
*Attorney, Agent, or Firm*—Kilpatrick Stockton LLP; Dean W. Russell; Richard A. Clegg

[57] ABSTRACT

An improved power-driven brush assembly is disclosed, useful for cleaning the interior surfaces of ducts, pipes, and other similar structures. The apparatus comprises a cable having a brush at one end, and a motor at the other end for spinning the cable and the brush. A casing surrounds the cable, allowing a fluid to be injected through the casing to the brush. A fluid directing assembly at the end of the casing near the brush allows fluid to the be injected into the duct in a desired direction, to flush particulate matter from the vicinity of the brush.

15 Claims, 4 Drawing Sheets

DUCT CLEANING APPARATUS

BACKGROUND OF THE INVENTION

1. Field of the Invention

The present invention relates generally to devices for cleaning the interior surfaces of ducts, pipes and other similar structures, including heating, ventilation and air conditioning ("HVAC") ductwork in residential and commercial buildings. In particular, the present invention relates to an improved power-driven brush assembly wherein a brush spins at one end of a hollow casing that is inserted into a duct or pipe, and air is injected from the casing in a desired direction to flush particulate matter from the duct or pipe.

2. Description of the Related Art

Different approaches have been developed for cleaning the interior surfaces of HVAC ducts and other similar structures. Such cleaning is often needed to remove dust, dirt and other debris that accumulates on the inner surfaces of ducts, which can cause allergic reactions or pose other health and safety risks.

For instance, powerful vacuum systems have been developed that are connected to one end of the ductwork to suction particulate matter from the duct. While these systems are generally effective for removing free particulate matter from the duct, they are not always effective at removing particulate matter that is firmly caked or coated onto the interior surfaces of the duct. In those situations, some form of mechanical agitation must be provided to dislodge the particulate matter from the interior surfaces of the duct.

To that end, various brush devices have been developed for use in combination with a vacuum system. These devices typically include a brush that is attached to the far end of a long flexible cable, which is surrounded by a flexible casing. The opposite end of the cable is attached to a motor, which spins the cable within the casing, causing the brush to spin at the far end of the casing. In practice, the brush is extended into a duct and the motor is activated to spin the brush, thereby dislodging particulate matter from the inner surfaces of the duct. The loosened particulate matter is then pulled from the duct by the vacuum system connected to one end of the duct.

To assist in flushing the loosened particulate matter from the duct, systems have been developed in which a continuous stream of fluid, usually water or air, is forced through the casing, and injected into the duct from the far end of the casing to flush particulate matter from the duct. Simultaneously, the vacuum system suctions the loosened particulate matter from the duct.

However, while such systems have been generally effective for cleaning ducts, they have suffered from several deficiencies. First, they have not provided a way to control or vary the direction in which the air is injected into the duct from the end of the casing. This is not a problem if the vacuum-induced flow within the duct is in the same direction as the injected air flow. However, depending on where the vacuum machine is connected to the duct, it is possible for the injected fluid to be flowing in the opposite direction of the vacuum-induced flow within the duct. Thus, the two flows will compete against one another, rather than complement one another, reducing the effectiveness of the evacuation process.

Second, the brushes that are currently available for use with such systems are not well suited for reaching into the corners of ducts having rectangular or square cross-sections.

In view of these deficiencies, it would be advantageous to provide a duct cleaning system that is capable of injecting a fluid into a duct through the casing in either a forward or a reverse direction, depending on the direction from which the vacuum is being pulled on the duct. It would also be desirable to have a system in which the brush is designed to clean easily and efficiently within the corner recesses of a square or rectangular duct system. These and numerous additional objects are accomplished by the present invention.

SUMMARY OF THE INVENTION

The present invention is an improved duct cleaning apparatus, which allows a fluid, preferably air, to be injected into the duct from the end of the casing in a variety of different pre-selected directions.

In a basic aspect, the apparatus comprises an elongated, flexible cable having a proximal end and a distal end, a cleaning tool attached to the distal end of the cable, means connected to the proximal end of the cable for spinning the cable, a flexible tubular casing surrounding the cable between the drive means and the cleaning tool, means for injecting a fluid into the proximal end of the casing and forcing the fluid towards the distal end of the casing, and a fluid directing assembly surrounding the cable between the distal end of the casing and the cleaning tool. The fluid-directing assembly allows the operator to adjust quickly and easily the direction in which fluid is injected into the duct from the casing. The fluid-directing assembly has a minimum number of moving parts and does not require any special tools to change the direction of the injected fluid.

The fluid directing assembly generally comprises a housing having an outer surface, an internal passage within, a first opening into the internal passage in direct fluid connection with the casing, a second opening at an opposite end of the housing, a first plurality of nozzles extending between the internal passage and the outer surface of the housing in a first direction, a second plurality of nozzles extending between the internal passage and the outer surface of the housing in a second general direction, different from the first general direction, and means for selectively closing the first plurality of nozzles when the second plurality of nozzles is open and for closing the second plurality of nozzles when the first plurality of nozzles is open. A fluid, forced into the fluid-directing apparatus through the casing, is injected into the duct in a pre-selected direction, through whichever nozzles are open. The distal end of the casing terminates at the housing, while the cable extends through the housing, with the cleaning tool (e.g., a brush) attached to the end of the cable on the opposite side of the housing.

In one embodiment of the present duct cleaning system, the brush comprises a first plurality of bristles and a second plurality of relatively longer, thinner bristles. The first plurality of bristles is stiff enough to support the brush and the casing within the duct and to provide vigorous agitation of coated particulate matter within the duct. The second plurality of bristles, being longer, thinner and more flexible than the first plurality of bristles, is able to reach into the far recesses of square or rectangular ducts, providing thorough cleaning of all surfaces within the duct.

DETAILED DESCRIPTION OF PREFERRED EMBODIMENTS

Figure 1:
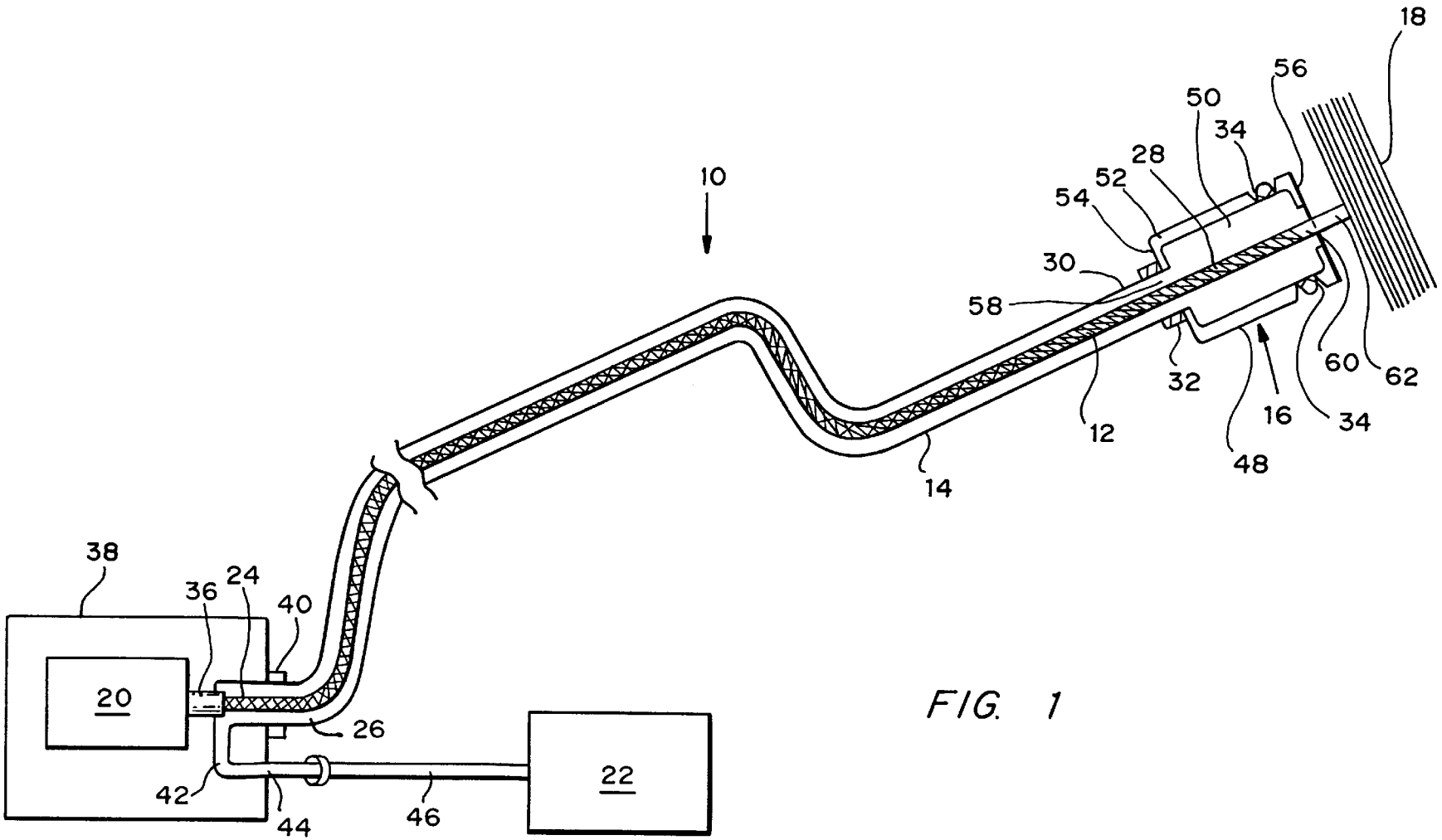
FIG. 1 of the drawing is a cross-sectional side view showing the various components of a duct cleaning system in accordance with the present invention.

Turning to FIG. 1, an embodiment 10 of the present invention comprises a cable 12, an outer casing 14, a fluid directing assembly 16, a cleaning tool 18 (preferably a brush with axially extending bristles), a cable-drive means 20 and an air source 22.

The cable 12 is disposed within the outer casing 14, with a proximal end 24 of the cable 12 extending from a proximal end 26 of the casing 14 and a distal end 28 extending from a distal end 30 of the casing. For most HVAC duct applications, the cable 12 is preferably a bi-directionally braided steel cable approximately ¼" in diameter. The cable should have sufficient length to allow access to all portions of the duct system, taking into account the availability of multiple access points into the duct system. The casing 14 comprises a flexible steel core with a rubber jacket and has an inner diameter that permits approximately 1/32" tolerance on each side of the cable. In general, the spacing between the cable 12 and the inner surface of the casing 14 should be sufficient to allow the cable 12 to spin within the casing 14, without allowing undue movement of the cable within the casing.

The air directing assembly 16 is connected to the distal end 30 of the casing 14 by means of a compression fitting 32, the details of which are well-known to persons of skill in the art. As discussed below in greater detail, the air-directing assembly 16 allows air from the casing to be injected into the duct in either a forward or rearward direction, through selected nozzles or orifices 34.

The proximal end 24 of the cable 12 is connected to the shaft 36 of the drive means 20, which can be a direct current motor contained within a housing 38. Alternatively, the drive means 20 can be any suitable turbine, motor or engine capable of spinning the cable 12 within the casing 14. The proximal end 26 of the casing 14 is connected to the housing 38 by a quick-connect fitting 40. An air tube 42, in fluid communication with the interior of the casing 14, allows air or other fluid to be injected into the proximal end of the casing 14, in a manner that is well known in the art. Air (or other fluid) is provided to the tube 42 through a fitting 44 that extends from the housing 38. Compressed air is provided to the fitting 44 through a hose 46 from the air source 22, usually a standard air compressor. The specifics of the various connections between the motor 20 and the cable 12, between the casing 14 and the housing 38, and between the air tube 42 and the casing 14, are all well known in the art and need not be addressed here in great detail. In an alternative embodiment of the claimed invention, the brush 18 is pneumatically or hydraulically driven, rather than cable driven. In this embodiment, the air or other fluid that is forced through the casing 14 causes the brush to spin, by impacting fins or blades associated with the shaft on which the brush is mounted. In this embodiment, the cable 12 is not necessary.

As illustrated in FIG. 1, the fluid-directing assembly 16 generally comprises a hollow housing 48, having an axial internal passage or bore 50 defined therein by a side wall 52, usually cylindrical in shape. The housing has a first end 54 and a second end 56. A plurality of nozzles 34 extend through the wall 52, extending from the internal passage 50 through the outer surface of the wall 52, with at least two of the nozzles being directed in different directions. In one embodiment, the plural nozzles include a first plurality of nozzles arranged around a first circumference of the housing, generally directed in a forward direction (i.e., towards the brush at the end of the cable), and a second plurality of nozzles arranged around a second circumference of the housing, generally directed in a rearward direction (i.e., away from the brush).

As described below in greater detail, the invention includes means for selectively closing the second plurality of nozzles when the first plurality of nozzles is open, and for closing the first plurality of nozzles when the second plurality of nozzles is open, to direct fluid in a desired direction as it exits the housing through the nozzles.

The distal end 30 of the casing is connected to the first end 54 of the housing by a compression fitting 32, with the interior of the casing 14 in direct fluid communication with the interior passage 50 of the housing 48 through an opening 58 in the end 54 of the housing. The cable 12 extends through the housing 48, terminating in a cleaning tool adapter 60 that extends through a second opening 62 at the second end 56 of the housing. A brush 18 or other cleaning tool is attached to the adapter 60, as described more fully below.

Figure 2:
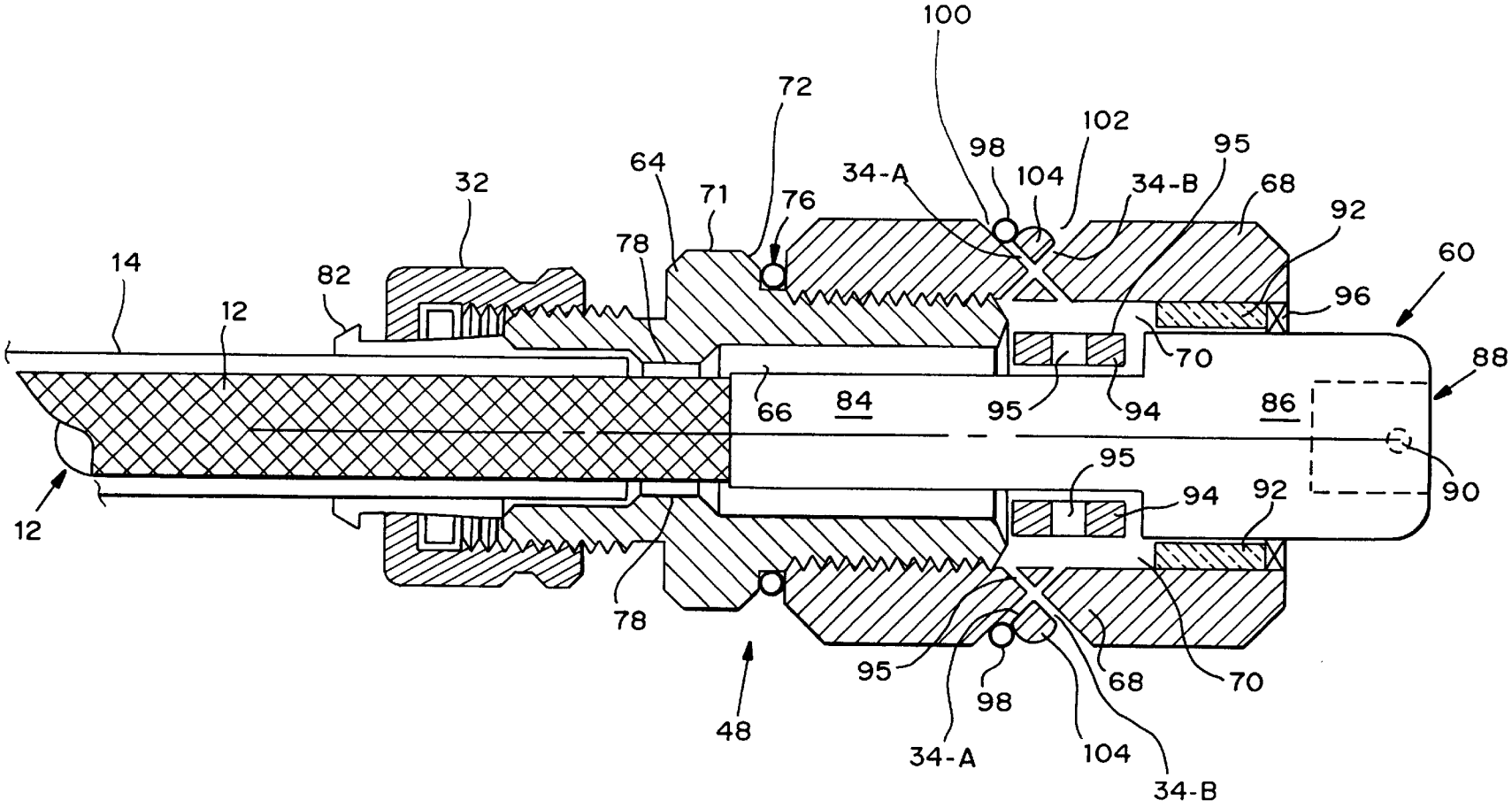
FIG. 2 of the drawing is a cross-sectional side view of an air-directing assembly that may form part of the duct cleaning assembly of FIG. 1.

Turning to FIG. 2, the details of a particular embodiment of the fluid directing assembly 28 are shown. In this embodiment, the housing 48 comprises a cylindrical sleeve 64, having an axial bore 66 therein, in combination with a collar 68 having an axial bore 70 therein. The sleeve 64 has a threaded region on each end of its outer surface. The collar 68 includes a threaded region on the inner surface of its bore, such that the collar 68 can be threaded onto one end of the sleeve 64, with the respective bores 66 and 70 of the sleeve and collar forming the unitary internal passage 50, shown in FIG. 1. The sleeve 64 is made of brass or steel, and includes a faceted radial flange 71 on its outer surface for accepting a wrench, to aid in assembly of the housing. The sleeve has a length of approximately 1 and ¼ inches. When the collar 68 is attached to the sleeve 64, a lateral face 72 of the flange 71 abuts the adjacent end of the collar, with an O-ring 76 positioned between the lateral face of the flange and the end of the collar to ensure a fluid seal between the sleeve and the collar. The bore 66 of the sleeve 64 includes an inwardly extending ridge 78, which acts as a stop for the distal end of the casing 14 when the casing is fastened to the sleeve, as described below.

The collar 68 is made of nylon or other suitable material. In one embodiment, the outer diameter of the collar is about 1½ inches, and the inner diameter of the bore is preferably about ¾ inches, with a length of approximately 2 and ⅜ inches. However, it will be readily appreciated by persons of skill in the art that the outer diameter of the collar (and of the sleeve) must be less than the inner diameter of whatever duct or pipe is being cleaned.

A first plurality of nozzles 34-A extend through the collar 68, extending from the internal passage 50 to the outer surface of the collar, generally directed in a rearward direction, i.e., towards the proximal end of the casing. A second plurality of orifices 34-B extend in a similar manner, generally directed in a forward direction, i.e., towards the brush. Each of the plural nozzles has an inner diameter of approximately 1/16th inches. In some embodiments, the first plurality and second plurality of orifices are inclined approximately 45 degrees from the longitudinal axis of the bores. In certain embodiments, the first plurality of nozzles includes eight nozzles, spaced equally about the circumference of the collar, with the axis of each nozzle parallel to the axis of the internal passage 50 of the housing 48. Similarly, the second plurality of nozzles includes eight nozzles, equally spaced around the collar, with the axis of each nozzle parallel to the axis of the internal passage 50 of the housing 48. Each of the first plural nozzles may intersect one of the second plural nozzles. However, the various nozzles do not necessarily intersect one another as they extend through the collar.

The distal end of the casing 14 is attached to sleeve 64 by means of a compression fitting 32, operating in cooperation with a brass insert 82 in a manner that is well-known to persons skilled in the art. The cable 12 extends from the distal end of the casing 14, into the internal passage 50, where it terminates in a cleaning tool adapter 60, which is crimped or otherwise integrated onto the end of the cable.

The adapter 60 comprises a first portion 84, having a first diameter, and a second, wider, portion 86 having an expanded diameter in relation to the first portion. The second, wider portion of the adapter 60 has an axial bore 88 therein, for receiving the shaft 114 of a brush assembly (shown in FIG. 3). When the shaft 114 of the brush 18 is inserted into the bore 88, a pair of holes 90 on opposite sides of the bore 88 align with a corresponding bore 116 in the shaft of the brush (shown in FIG. 3). A pin (not shown) is then inserted through the aligned holes to hold the brush in place.

A bronze guide bushing 92 encircles the adapter 60 near the distal end of the collar 68, to stabilize the adapter 60 within the collar. A spacer ring 94, with a plurality of radially extending bores 95 therein, encircles the first, narrower, portion of the adapter 60, between the adjacent end of the sleeve and the second, wider portion of the adapter. The spacer bore prevents the adapter from shifting its axial position within the housing. The spacer ring is preferably nylon or other suitable material, with four equally spaced bores. A hard rubber ring seal 96 is positioned between the brush adapter and the inner surface of the collar at the distal end of the collar, to seal the internal passage at that end of the collar. The ring seal should fit tightly within the inner bore of the collar 68 to hold the seal in place, while providing sufficient clearance with respect to the adapter 60 to allow that adapter to spin within the housing in a normal manner. To control the direction of air leaving the air-directing assembly, the apparatus includes nozzle-closing means for selectively closing the first plurality of nozzles when the second plurality of nozzles is open and for selectively closing the second plurality of nozzles when the first plurality of nozzles is opened. In the particular embodiment shown in FIG. 2, the nozzle closing means is an O-ring 98 positioned about the circumference of the collar, such that the O-ring will selectively cover the outer opening of either the first or second plurality of nozzles.

To hold the O-ring 98 in position, the outer surface of the collar 68 defines a first detent groove 100 around the periphery of the collar, intersecting the first plurality of nozzles, and a second detent groove 102 around the periphery of the collar, intersecting the second plurality of nozzles. The first and second detent grooves 100 and 102 are separated by a ridge 104 extending around the circumference of the collar.

To change the direction of the airflow leaving the collar, an operator simply rolls the O-ring 98 into the appropriate detent groove 100 or 102, closing whichever set of nozzles is appropriate. This allows an operator quickly and easily to change the direction of airflow from the collar, without the need for any special tools. To ensure a thorough seal of the nozzles, the O-ring 98 should fit tightly about the collar, with an inner diameter in its relaxed state that is slightly less than the outer diameter of the collar inside the respective detent grooves.

While the O-ring structure described above is a suitable nozzle closing means, any of a variety of equivalent means can be used to close the nozzles. For instance, any device or structure associated with the surface of the housing that will selectively seal one set of holes, while leaving others open, can be used. Alternatively, individual plugs can be used to plug individual nozzles.

In the embodiment shown in FIG. 1, the air flow pattern in the apparatus 10 begins with air (or other fluid) being injected into the casing at its proximal end. The air flows through the casing 14, into the interior passage 50 of the housing 48. Turning to FIG. 2, the air flows through the bore 66 of the sleeve 64, between the inner surface of the sleeve 64 and the outer surface of the cable 12, and into the bore 70 of the collar 68. Within the collar, the air flows through the plural holes 95 in the spacer ring 94, and into the space between the inner surface of the collar and the outer surface of the brush adapter 60. The air is then injected into the duct through the desired nozzles 34-A or 34-B.

In operation, the distal end of the apparatus, including the brush and the air directing housing, is inserted into a duct. A vacuum is pulled from one end of the duct, while the brush and cable are spun via the drive means 20. At the same time, a fluid (preferably air) is injected into the duct in the manner describe above.

The speed of the brush, or the rotational direction of the brush, can be controlled by means of a control knob or foot pedal associated with the motor, in a manner that is well known to person skilled in the art.

Figure 3:
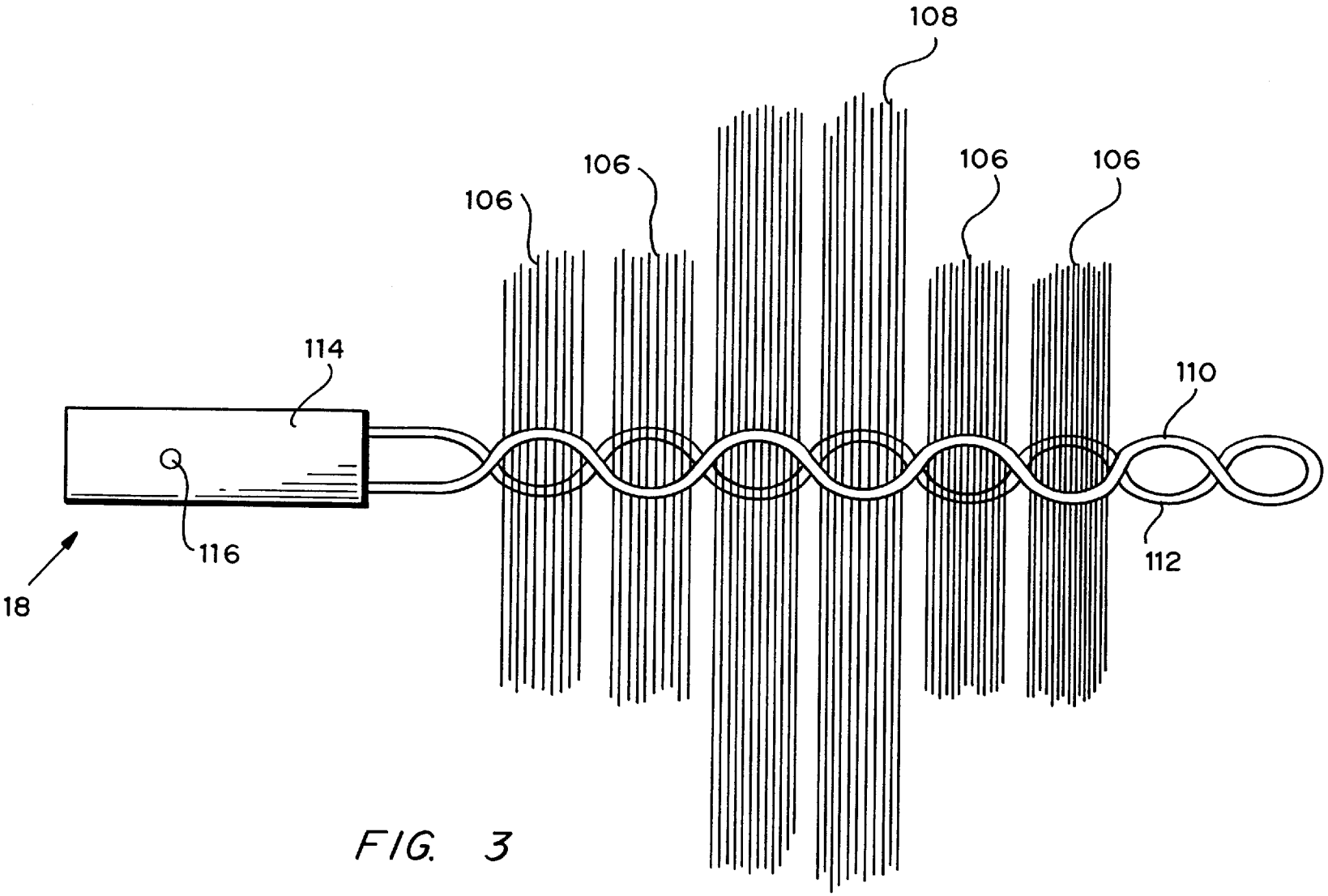
FIG. 3 of the drawing is a side view of a brush for use as part of the duct cleaning-assembly of FIG. 1.
Figure 4:
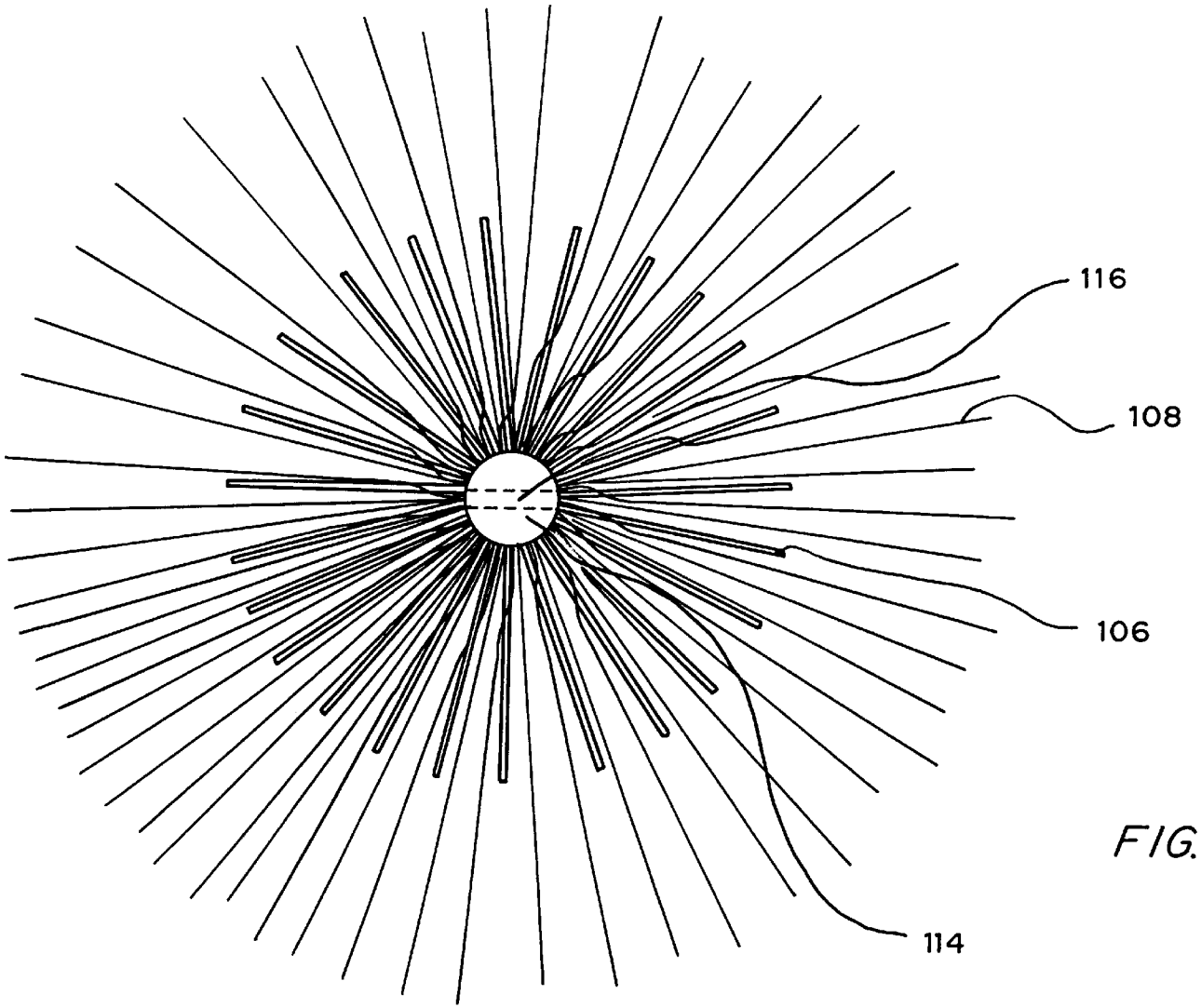
FIG. 4 of the drawing is an end view of the brush of FIG. 3.

Turning to FIGS. 3 and 4, in an embodiment of the present duct cleaning system, the brush 18 comprises a first plurality of bristles 106, and a second plurality of relatively longer, thinner bristles 108. The shorter, stiffer bristles 106 support the weight of the distal end of the assembly 10, maintaining the brush 18 centered within the duct. They also provide vigorous, aggressive cleaning of firmly caked materials. The longer, thinner and more flexible bristles 108 are able to reach into the far recesses of square or rectangular ducts, providing thorough cleaning of all surfaces within the duct.

As shown in FIG. 3, the bristles are connected to the brush 18 by entertwining them in a twisted pair of steel cables 110 and 112, one end of which is attached to the end of the shaft 114 of the brush 18. In one embodiment, the shaft comprises a single length of double stranded cable, which is bent at its mid-point to form a two side-by-side double stranded lengths, which are then twisted about one another in the manner shown in FIG. 4 to hold the bristles 106 and 108 in place between the twisted lengths.

In one embodiment, the shorter bristles 106 are radially extending polypropylene bristles that are approximately 7 inches long, with a diameter of approximately 36/1000th inches and a bristle density of about 40 bristles per axial inch of brush, and the longer bristles are radially extending polypropylene bristles approximately 13 inches long, with a diameter of approximately 16/1000 inches.

In another embodiment, the shorter bristles 106 are approximately 11 inches long, with a diameter of approximately 45/1000 inches and a bristle density of about 24 bristles per axial inch of brush and the longer bristles are radially extending polypropylene bristles approximately 13 inches long, with a diameter of approximately 16/1000 inches. The bristle density of the second plurality of bristles is preferably about 120 bristles per axial inch.

The first and second plurality of bristles can be segregated from one another along the axial length of the brush or can be uniformly dispersed among one another. Preferably, the brush 18 includes about 3 inches of longer bristles, with about 2½ inches of shorter bristles on each side of the longer bristles.

Although the present invention has been described by reference to various preferred embodiments, persons of skill in the art will recognize that various modifications may be made to those embodiments without departing from the scope and spirit of the invention as set forth in the following claims. By way of example only, while the invention is generally described as a means for cleaning HVAC ducts, it is generally applicable for cleaning any type of enclosed space, such as a pipe or other similar structure. In addition, any of a variety of cleaning tools, including drill bits, abrasive tools, grinding tips, steel brushes, buffing tools, flare cone tools, spring arm tools, and the like can be used. Moreover, while the invention has been generally described by reference to an air injection system, it may also be used with any other suitable gas or liquid.

What is claimed is:

1. An apparatus for cleaning an interior surface of a duct, comprising a) an elongated, flexible cable having a proximal end and a distal end;

b) a cleaning tool attached to the distal end of the cable;

c) drive means, connected to the proximal end of the cable, for spinning the cable;

d) a flexible tubular casing surrounding the cable between the drive means and the cleaning tool, the casing having a proximal end corresponding to the proximal end of the cable and a distal end corresponding to the distal end of the cable;

e) means for injecting a fluid into the proximal end of the casing and forcing the fluid towards the distal end of the casing;

f) a fluid directing assembly surrounding the cable between the distal end of the casing and the cleaning tool, the fluid directing assembly comprising (i) a housing having an outer surface and an internal passage within the housing, (ii) a first opening into the internal passage in direct fluid connection with the casing, (iii) a second opening at an opposite end of the housing, wherein the cable extends through the first and second openings of the housing, (iv) a first plurality of nozzles extending between the internal passage and the outer surface of the housing in a first general direction, (v) a second plurality of nozzles extending between the internal passage and the outer surface of the housing in a second general direction, different from the first general direction; and (vi) means for selectively closing the first plurality of nozzles when the second plurality of nozzles is open and for closing the second plurality of nozzles when the first plurality of nozzles is open.

2. The apparatus of claim 1, wherein the means for injecting a fluid into the proximal end of the casing and forcing the fluid towards the distal end of the casing is an air compressor.

3. The apparatus of claim 2, wherein the nozzle closing means comprises an O-ring adapted to fit around the outer surface of the housing, selectively covering either the first or second plurality of nozzles.

4. The apparatus of claim 3, wherein the outer surface of the housing defines a first detent groove around the periphery of the housing for holding the O-ring in position over the first plurality of nozzles and a second detent groove around the periphery of the housing for holding the O-ring in position over the second plurality of nozzles.

5. The apparatus of claim 4, wherein the housing comprises a cylindrical sleeve having a threaded outer surface and an axial bore therein and a collar having an threaded inner surface and an axial bore therein, wherein the collar is threaded onto the sleeve such that the inner bores of the sleeve and the collar together form the internal passage of the housing.

6. The apparatus of claim 5, wherein the first and second plurality of nozzles extend through the collar portion of the housing.

7. The apparatus of claim 6, wherein the first and second pluralities of nozzles are inclined approximately 45 degrees from the longitudinal axis of the internal passage and are oriented approximately 90 degrees from one another.

8. The apparatus of claim 7, wherein the distal end of the cable terminates in an axially extending cleaning tool adapter for attaching a cleaning tool to the cable, the adapter comprising a first cylindrical portion having a first diameter, and a second cylindrical portion having a second, wider diameter and a bore therein for receiving the shaft of a cleaning tool.

9. The apparatus of claim 8, comprising a guide bushing that surrounds the cleaning tool adapter near the second opening of the housing to stabilize the adapter within the housing.

10. The apparatus of claim 9, comprising a spacer ring that encircles the first portion of the cleaning tool adapter within the collar.

11. The apparatus of claim 10, comprising an annular fluid seal between the second portion of the cleaning tool adapter and the inner surface of the collar, at the second opening of the housing.

12. The apparatus of claim 1, wherein the cleaning tool is a brush comprising a plurality of bristles.

13. The apparatus of claim 12, wherein the brush comprises a first plurality of bristles and a second plurality of relatively longer, more flexible bristles.

14. An apparatus for cleaning an interior surface of a structure, comprising a) an elongated flexible casing having a proximal end and a distal end;

b) means for forcing a fluid through the casing to the distal end of the casing; and c) a fluid directing assembly connected to the distal end of the casing, the fluid directing assembly comprising (i) a housing having an outer surface and an internal passage in fluid communication with the casing;

(ii) a first plurality of nozzles extending between the internal passage and the outer surface of the housing in a first direction, (iii) a second plurality of nozzles extending between the internal passage and the outer surface of the housing in a second general direction, different from the first general direction; and (iv) means for selectively closing the first plurality of nozzles when the second plurality of nozzles is open and for closing the second plurality of nozzles when the first plurality of nozzles is open;

the apparatus further comprising a cleaning tool connected to the fluid-directing assembly; and means for spinning the cleaning tool.

15. The apparatus of claim 14 wherein the means for selectively closing the first plurality of nozzles when the second plurality of nozzles is open and for closing the second plurality of nozzles when the first plurality of nozzles is open comprises an O-ring adapted to fit around the outer surface of the housing, selectively covering either the first or second plurality of nozzles; and wherein the outer surface of the housing defines a first detent groove around the periphery of the housing for holding the O-ring in position over the first plurality of nozzles and a second detent groove around the periphery of the housing for holding the O-ring in position over the second plurality of nozzles.

* * * * *